US009112279B2

(12) United States Patent
Montgomery et al.

(10) Patent No.: US 9,112,279 B2
(45) Date of Patent: Aug. 18, 2015

(54) APERTURE MODE FILTER

(75) Inventors: James P. Montgomery, Marietta, GA (US); Shawn D. Rogers, Johns Creek, GA (US); Michael G. Guler, Dawsonville, GA (US)

(73) Assignee: Honeywell International Inc., Morristown, NJ (US)

( * ) Notice: Subject to any disclaimer, the term of this patent is extended or adjusted under 35 U.S.C. 154(b) by 667 days.

(21) Appl. No.: 13/371,646

(22) Filed: Feb. 13, 2012

(65) Prior Publication Data

US 2012/0218160 A1 Aug. 30, 2012

Related U.S. Application Data

(60) Provisional application No. 61/446,609, filed on Feb. 25, 2011.

(51) Int. Cl.

| | |
|---|---|
| ***H01Q 13/00*** | (2006.01) |
| ***H01P 11/00*** | (2006.01) |
| ***H01P 1/207*** | (2006.01) |
| ***H01Q 19/02*** | (2006.01) |
| ***H01Q 13/02*** | (2006.01) |
| ***H01Q 21/06*** | (2006.01) |

(52) U.S. Cl.

CPC ..... *H01Q 19/026* (2013.01); *H01Q 13/0275* (2013.01); *H01Q 19/025* (2013.01); *H01Q 21/064* (2013.01); *Y10T 29/49016* (2015.01)

(58) Field of Classification Search

CPC ..... H01Q 13/00
USPC ..... 343/776
See application file for complete search history.

(56) References Cited

U.S. PATENT DOCUMENTS

| | | | | |
|---|---|---|---|---|
| 6,028,562 | A | 2/2000 | Guler et al. | |
| 6,127,985 | A | 10/2000 | Guler | |
| 6,917,326 | B1 * | 7/2005 | Tregenza et al. | 342/124 |
| 8,026,859 | B2 | 9/2011 | McLean | |
| 2006/0038732 | A1 | 2/2006 | DeLuca et al. | |
| 2006/0145694 | A1 | 7/2006 | Oppenlander et al. | |

(Continued)

FOREIGN PATENT DOCUMENTS

| | | |
|---|---|---|
| EP | 0136817 | 4/1985 |
| JP | 2004207856 | 7/2004 |

(Continued)

OTHER PUBLICATIONS

European Patent Office, "Office Action", Jun. 12, 2012, Published in: EP.

(Continued)

*Primary Examiner* — Dameon E Levi
*Assistant Examiner* — Andrea Lindgren Baltzell
(74) *Attorney, Agent, or Firm* — Fogg & Powers LLC

(57) ABSTRACT

A mode filter for an antenna having at least one element aperture is provided. The mode filter includes at least one waveguide extension to extend the at least one element aperture, and at least one two-by-two (2×2) array of quad-ridged waveguide sections connected to a respective at least one waveguide extension. When the at least one waveguide extension is positioned between the at least one element aperture and the at least one two-by-two (2×2) array of quad-ridged waveguide sections, undesired electromagnetic modes of the antenna are suppressed.

17 Claims, 10 Drawing Sheets

(56) References Cited

U.S. PATENT DOCUMENTS

| | | | | |
|---|---|---|---|---|
| 2009/0284440 | A1 * | 11/2009 | Weidmann et al. | 343/893 |
| 2011/0057849 | A1 | 3/2011 | Naym et al. | |

FOREIGN PATENT DOCUMENTS

| | | | | |
|---|---|---|---|---|
| KR | WO 2008/069369 | A1 * | 6/2008 | H01Q 21/29 |
| WO | 2008069369 | | 12/2008 | |

OTHER PUBLICATIONS

European Patent Office, "Communication under Rule 71(3) EPC", "from Foreign Counterpart of U.S. Appl. No. 13/371,646", May 16, 2013, pp. 1-38, Published in: EP.

European Patent Office, "European Search Report", mailed May 29, 2012, Published in: EP.

* cited by examiner

APERTURE MODE FILTER

This application claims the benefit of U.S. Provisional Application No. 61/446,609, filed on Feb. 25, 2011, which is incorporated herein by reference in its entirety.

BACKGROUND

Antenna radiating elements can emit electromagnetic radiation in grating lobes. These side lobes cause interference in communication systems by radiating in undesired directions and also cause power loss and gain loss in the desired direction.

SUMMARY

The present application relates to a mode filter for an antenna having at least one element aperture. The mode filter includes at least one waveguide extension to extend the at least one element aperture, and at least one two-by-two (2×2) array of quad-ridged waveguide sections connected to a respective at least one waveguide extension. When the at least one waveguide extension is positioned between the at least one element aperture and the at least one two-by-two (2×2) array of quad-ridged waveguide sections, undesired electromagnetic modes of the antenna are suppressed.

DRAWINGS

FIG. 1B is an enlarged view of a portion of the at least one layer of the antenna of FIG. 1A;

In accordance with common practice, the various described features are not drawn to scale but are drawn to emphasize features relevant to the present invention Like reference characters denote like elements throughout figures and text.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

The antennas described herein are configured with aperture mode filters to reduce the electromagnetic radiation emitted in the side lobes (grating lobes). The antennas shown herein include horn elements with aperture mode filters. The aperture mode filters described herein function in a similar manner when attached to other types of antenna elements, such as waveguide antenna elements, as is understandable to one skilled in the art upon reading this document.

Figure 1A:
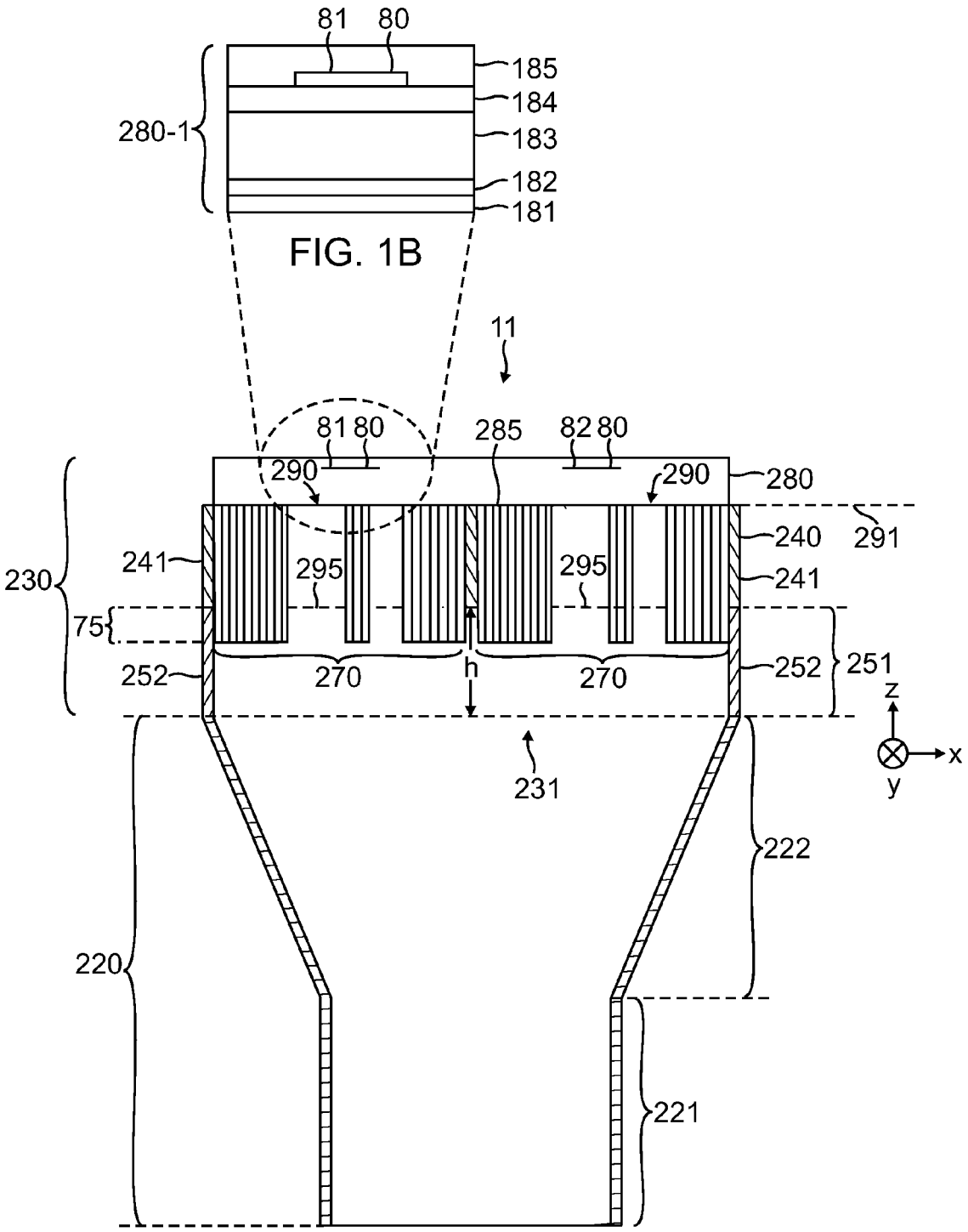
FIG. 1A is a cross-section view of an embodiment of an antenna with a single antenna radiating element and an aperture mode filter in accordance with the present invention.
Figure 1C:
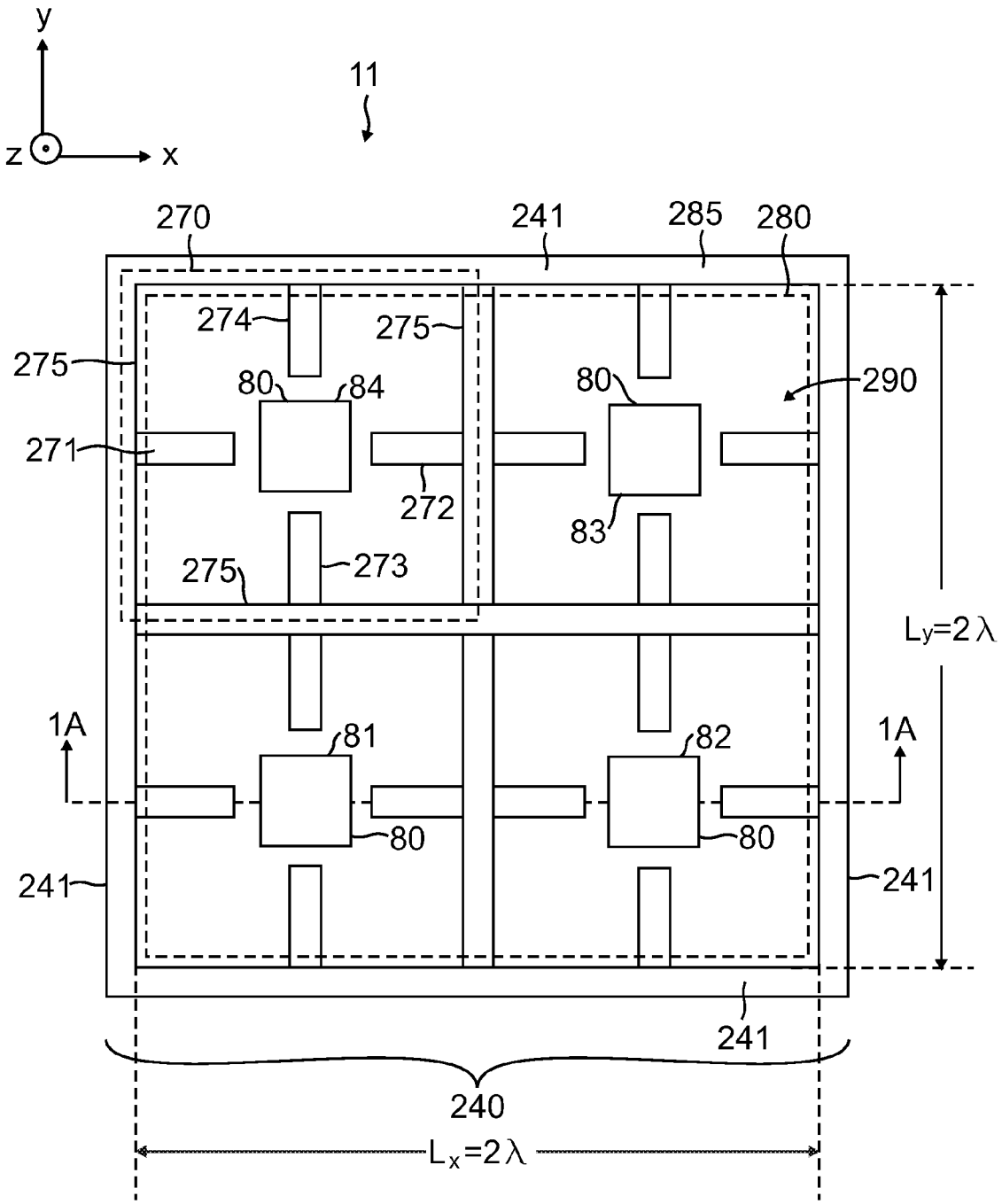
FIG. 1C is a top view of the embodiment of the antenna of FIG. 1A.

FIG. 1A is a cross-section view of an embodiment of an antenna 11 with a single antenna radiating element 220 and an aperture mode filter 230 in accordance with the present invention. FIG. 1B is an enlarged view of a portion 280-1 of the at least one layer 280 of the antenna 11 of FIG. 1A. In FIG. 1B, the various layers 181-185 of the at least one layer 280 are visible. The at least one layer 280 is also referred to herein as "layer 280", "matching layer 280", or "reactive matching layer 280". FIG. 1C is a top view of the embodiment of the antenna 11 of FIG. 1A. The plane upon which the cross-section view of FIG. 1A is taken is indicated by section line 1A-1A in FIG. 1C.

Antenna 11 includes antenna element 220 and an aperture mode filter 230. The aperture mode filter 230 is structured to eliminate or reduce undesired side lobes from the electromagnetic radiation emitted from the antenna 11. In this manner, more power is emitted broadside from the antenna 11 in modes that propagate parallel to the z axis. The "aperture mode filter 230" is also referred to herein as "mode filter 230".

As shown in FIG. 1A, the antenna element 220, which radiates electromagnetic radiation, includes an input waveguide 221 and a horn element 222. The horn element 222 has an opening or aperture represented generally at 231 that spans the x-y plane. The "aperture 231" is also referred to herein as "element aperture 231" and "horn aperture 231".

The mode filter 230 includes one or more waveguide extensions 251 and a 2×2 array 240 of quad-ridged waveguide sections 270. The mode filter 230 also includes at least one layer 280 positioned adjacent to or spaced above the aperture side 285 of the 2×2 array 240 of quad-ridged waveguide sections 270. The at least one layer 280 is configured to at least reduce a reflection coefficient of the antenna 11. In one implementation of this embodiment, the layer 280 includes at least one dielectric layer. In another implementation of this embodiment, the layer 280 includes at least one dielectric layer, and at least one metallic patch. In the embodiment shown in FIG. 1B, the layer 280 includes dielectrics (e.g., layers 181-185 shown in FIG. 1B) and at least one metallic patch 81-84 (FIG. 1C). The dielectrics 181-185 and metallic patches 81-84 present a shunt capacitive reactance to the antenna 11.

Figure 9:
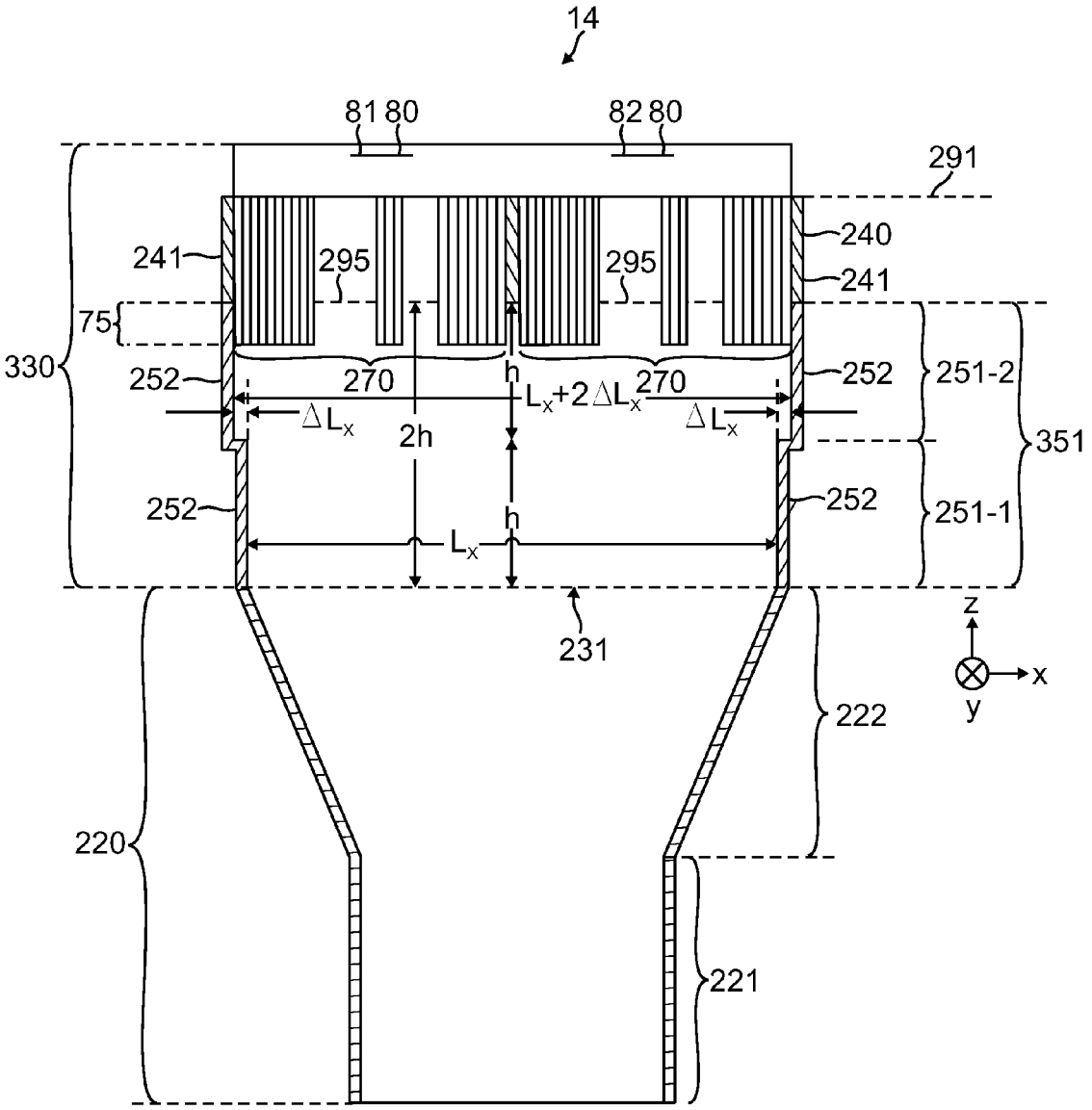
FIG. 9 is a cross-section view of an embodiment of an antenna with a single antenna radiating element in accordance with the present invention.

The mode filter 230 is positioned adjacent to the element aperture 231 of the antenna radiating element 220. Adjacent, as used herein, is based on the standard dictionary definition of near, close, or contiguous, therefore elements adjacent each other are either contacting each other or near to each other. The waveguide extension 251 extends the horn aperture 231 with a short section of square waveguide, which creates a mode box or moder. Thus, the "waveguide extension 251" is also referred to herein as a "moder 251". In one implementation of this embodiment, two or more moders with varying x-y dimensions are stacked, as shown in FIG. 9, which is described below.

The waveguide extension 251 has square cross-sectional dimensions ($L_x$, $L_y$) on the order of two wavelengths (2λ), such that $L_x=L_y\approx 2\lambda$. The waveguide extension 251 propagates higher order modes that, if allowed to radiate, would couple to higher-order Floquet modes that radiate in unintended directions. Thus, the mode filter 230 mitigates higher order modes present at the aperture 231 that arise from the horn element 222 and waveguide 221 in order to prevent them from coupling to the higher order Floquet modes. With the mode filter 230 in place, the grating lobes are reduced and the antenna far field pattern has improved side lobe levels and directivity In FIG. 1C, the upper-left quad-ridged waveguide section of the 2×2 array 240 is outlined by a dashed line indicated with the numerical label 270. The four quad-ridged waveguide sections 270 each include four metal ridges 271-274 that extend from the side walls 275 of the quad-ridged waveguide section 270. The four metal ridges 271-274 are also referred to herein as "ridges 271-274". In FIG. 1C, the layer 280 is shown as a dashed square.

In the cross-section view of FIG. 1A, only two quad-ridged waveguide sections 270 and two metallic patches 81-82 are visible. The antenna 11 emits electromagnetic radiation from the horn element 222 through the element aperture 231 to the aperture mode filter 230. The electromagnetic radiation propagates through the aperture mode filter 230 and is output from the antenna 11 through the opening or aperture 290 that spans the x-y plane shown in cross-section by the dashed line 291 in FIG. 1A. The aperture side 285 of the 2×2 array 240 of quad-ridged waveguide sections 270 is the surface of the 2×2 array 240 of quad-ridged waveguide sections 270 farthest from the waveguide extension 251.

The waveguide extension 251 is positioned between the element aperture 231 and the aperture side 285 of the 2×2 array 240 of quad-ridged waveguide sections 270. The side walls 241 of the two-by-two (2×2) array 240 of quad-ridged waveguide sections 270 are in contact with the side walls 252 (FIG. 1A) of the waveguide extension 251. The dashed line 295 (FIG. 1A) indicates a cross-section view of the x-y plane in which the side walls 241 of the two-by-two (2×2) array 240 and the side walls 252 (FIG. 1A) of the waveguide extension 251 contact each other.

As shown in FIG. 1A, a portion 75 of the 2×2 array 240 of quad-ridged waveguide sections 270 extends into the space enclosed by waveguide extension 251. Specifically, the portion 75 penetrates the plane 295 shown in FIG. 1A. The portion 75 is shown to extend about half the height "h" of the waveguide extension 251 in the z direction; however this is just one example. In one implementation of this embodiment, the portion 75 extends less than halfway into the area enclosed by the waveguide extension 251 in the z direction. In another implementation of this embodiment, the portion 75 extends more than halfway into the area enclosed by the waveguide extension 251 in the z direction. In yet another implementation of this embodiment, the 2×2 array 240 of quad-ridged waveguide sections 270 does not penetrate the plane 295 and does not extend into the area enclosed by the waveguide extension 251.

The reactive matching layer 280 is a plurality of layers 181-185 (FIG. 1B) that are bonded or mechanically attached to the surfaces of quad-ridged waveguide sections 270 exposed at the aperture 290 that spans the x-y plane shown in cross-section by the dashed line 291 in FIG. 1A. In another implementation of this embodiment, the reactive matching layer 280 is supported above the aperture 290 by standoffs that provide an air space between the reactive matching layer 280 and the aperture 290. In yet another implementation of this embodiment, the reactive matching layer 280 is bonded or mechanically attached to the side walls 241 of the two-by-two (2×2) array 240 that enclose the aperture 290. The metallic patches 81, 82, 83, and 84 are positioned in an array within the reactive matching layer 280 so that a metallic patch 81, 82, 83, and 84 is positioned above a center region of a respective quad-ridged waveguide section 270.

As shown in FIG. 1B, the reactive matching layer 280 includes a plurality of layers 181, 182, 183, 184, and 185 and metallic patches 81, 82, 83, and 84. A first metallic patch 81 is shown in FIG. 1B. In one implementation of this embodiment, the first layer 181 is a layer of polyimide material, the second layer 182 is a layer of adhesive material, the third layer 183 is a layer of relatively low dielectric constant material, the fourth layer 184 is a layer of adhesive material, and the fifth layer 185 is a layer of polyimide material. The first layer 181 is in contact with the quad-ridged waveguide sections 270. The second layer 182 overlays the first layer 181 so the first layer 181 is between the quad-ridged waveguide sections 270 and the second layer 182. The third layer 183 overlays the second layer 182. The fourth layer 184 overlays the third layer 183. The fifth layer 185 overlays the fourth layer 184 and the metallic patch 81 so that the metallic patch 81 is sandwiched between the fifth layer 185 of polyimide material and the fourth layer 184 of adhesive material.

In one implementation of this embodiment, first layer 181 is a 2 mil layer of Kapton, the second layer 182 is a 1.5 mil layer Arlon Adhesive, the third layer 183 is a thick layer (54 mils) of Rohacell Foam, the fourth layer 184 is 1.5 mil layer of Arlon Adhesive, and the fifth layer 185 is a 2 mil layer of Kapton with copper patches on one side or the other. The copper patches 81-84 are formed by standard circuit board etching processes. All these layer thicknesses are approximate and other layer thicknesses are possible. In another implementation of this embodiment, the patches 81-94 are formed form other metallic materials.

As shown in FIGS. 1A and 1C, the x-direction dimension (length) $L_x$ of the waveguide extension 251 is approximately the same (on the same order of magnitude) as the x-direction dimension (length) $L_x$ of the element aperture 231. Similarly, the y-direction dimension (length) $L_y$ of the waveguide extension 251 is approximately the same (on the same order of magnitude) as the y-direction dimension (length) $L_y$ of the element aperture 231. Both $L_x$ and $L_y$ are approximately twice a wavelength, 2λ, of electromagnetic radiation emitted by the antenna radiating element 220.

Many antenna systems are formed from an array of the antennas, such as antennas 11 shown in FIGS. 1A and 1C, in which the antenna elements in the array include aperture mode filters. Antenna arrays increase the directivity of the antenna by a superposition of the electromagnetic field from each antenna element. Embodiments of array antennas and associated array of aperture mode filters are arranged in a variety of sizes and shapes including: a 1×N array, an N×M array, or an N×N array, where N and M are positive integers.

Figure 2:
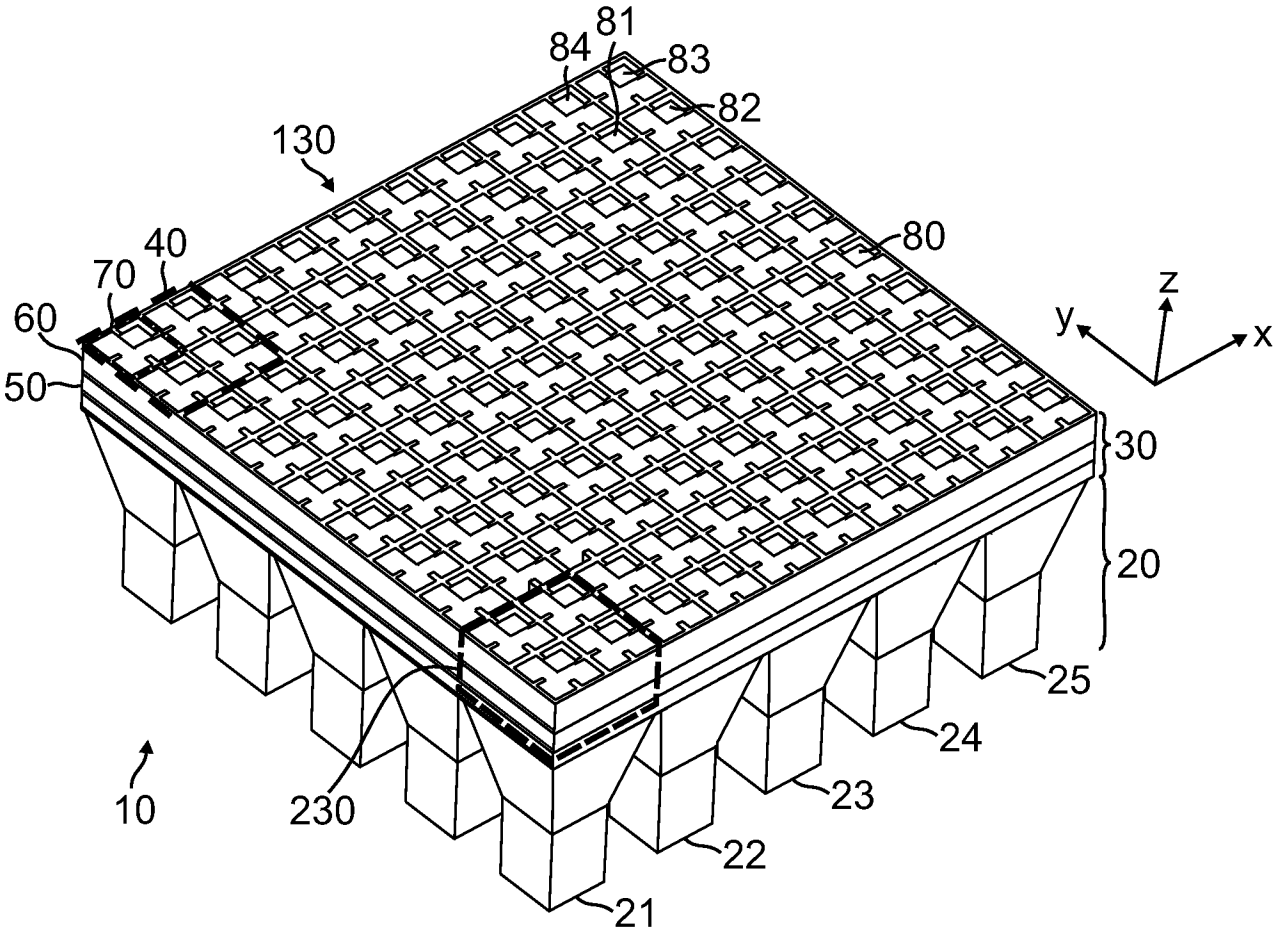
FIG. 2 is an oblique view of an embodiment of an antenna with an antenna-array and an aperture mode filter array in accordance with the present invention.

FIG. 2 is an oblique view of an embodiment of an antenna 10 with an antenna-array 20 and an aperture mode filter array 30 in accordance with the present invention. As shown in FIG. 2, the antenna 10 is a 5×5 array of antennas 11. The antenna array 20 is an array of antenna radiating elements represented generally at 21-25.

The aperture mode filter array 30 (FIG. 2) is an array of the aperture mode filters 230 shown in FIGS. 1A and 1C. The "aperture mode filter array 30" is also referred to herein as a "mode filter 30". The mode filter 30 is positioned on or above the antenna radiating elements 21-25 of the antenna array 20 to suppress undesired electromagnetic modes of the antenna radiating elements 21-25.

The mode filter 30 includes an extension-array 50 and a quad-ridged-waveguide array 60. The extension-array 50 is positioned between the quad-ridged-waveguide array 60 and the antenna-array 20 of antenna radiating elements 21-26.

The mode filter 30 of the antenna 10 shown in FIG. 2 also includes a matching layer 80 positioned adjacent to an aperture side 130 of the quad-ridged-waveguide array 60. The matching layer 80 reduces the reflection coefficient of the antenna-array 20. The matching layer 80 has the structure and function of the matching layer 280 shown in FIG. 1B as described above with reference to FIGS. 1A-1C.

Figure 3:
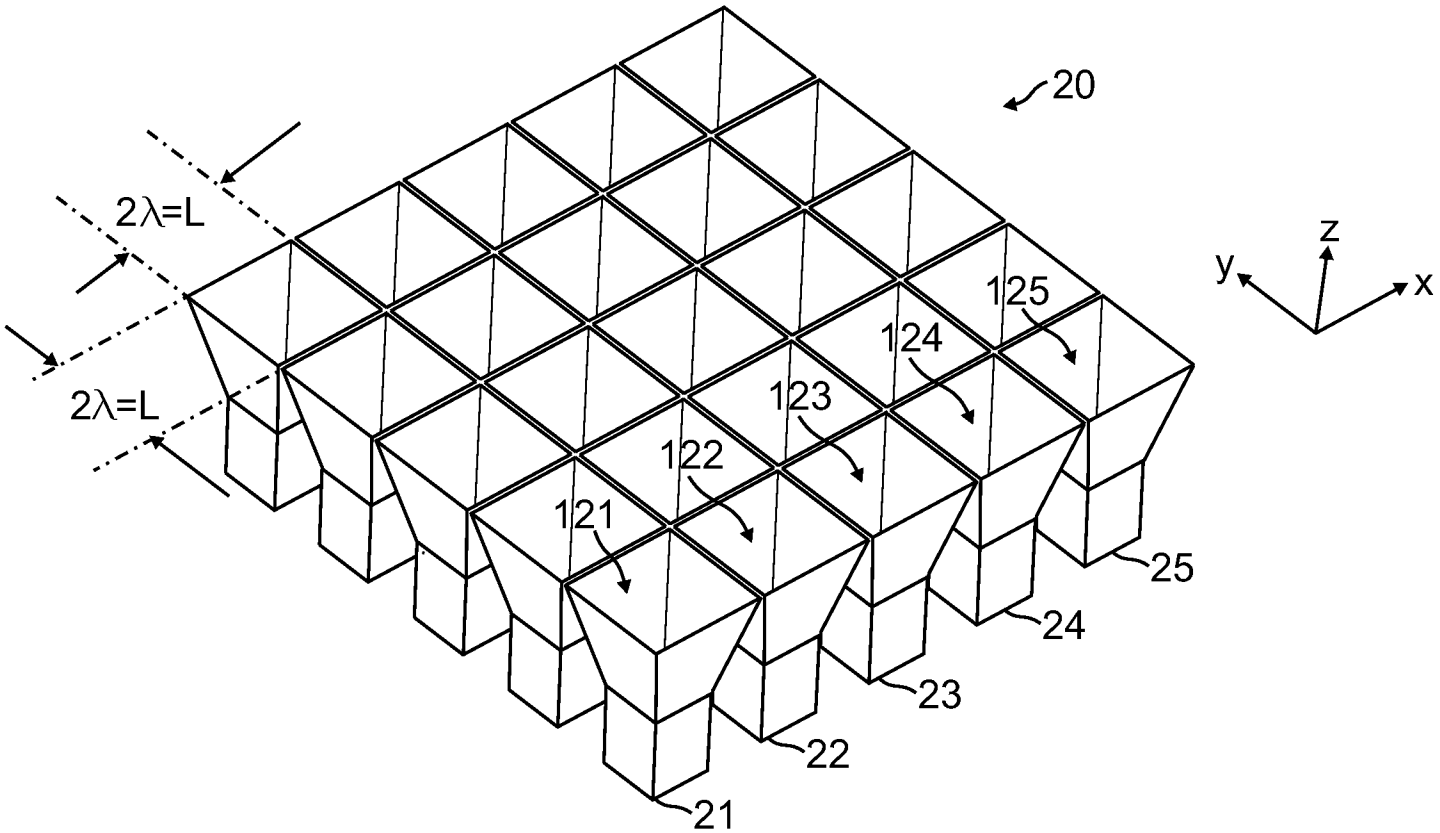
FIG. 3 is an oblique view of an antenna-array in the antenna shown in FIG. 2.

FIG. 3 is an oblique view of an antenna-array 20 in the antenna 10 shown in FIG. 2. The "antenna-array 20" is also referred to herein as an "array of antennas 20". As shown in FIGS. 2 and 3, the array of antenna elements 20 is an array of horn antennas represented generally at 21-25 that are similar in structure and function to the horn antenna 220 shown in FIG. 1A. The horn antennas 21-25 (also referred to herein as "antenna radiating elements 21-25") have respective element apertures 121-125.

Figure 4:
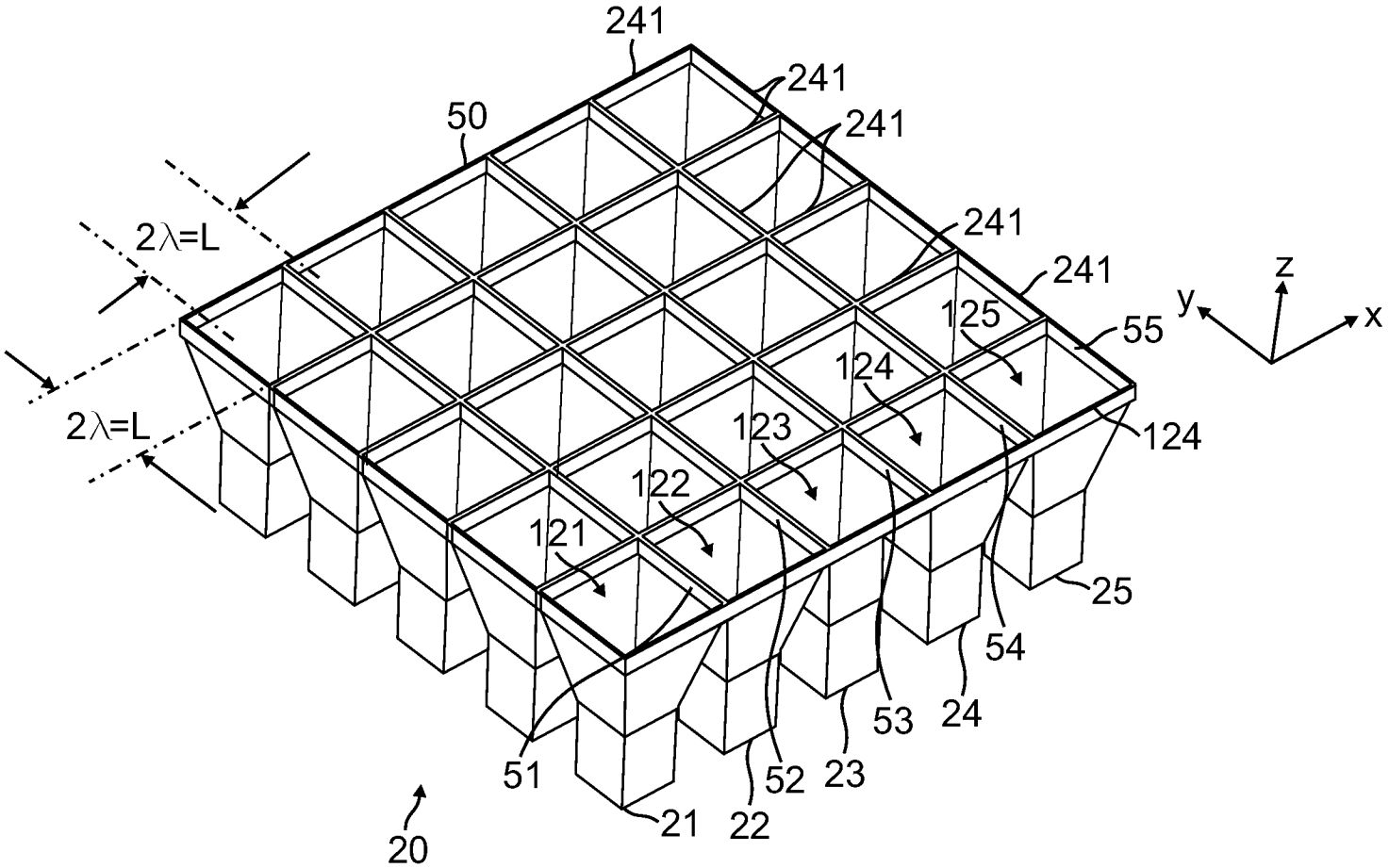
FIG. 4 is an oblique view of the array of the horn antennas of FIG. 3 configured with an extension-array.

FIG. 4 is an oblique view of the array of the horn antennas 20 of FIG. 3 configured with an extension-array 50. The extension-array 50 is an array of waveguide extensions represented generally at 51-55. The waveguide extensions 51-55 are similar in structure and function to the waveguide extension 251 shown in FIGS. 1A and 1C. As shown in FIG. 4, there is a one-to-one correspondence between the horn antennas 21-25 and the waveguide extensions 51-55.

Figure 5:
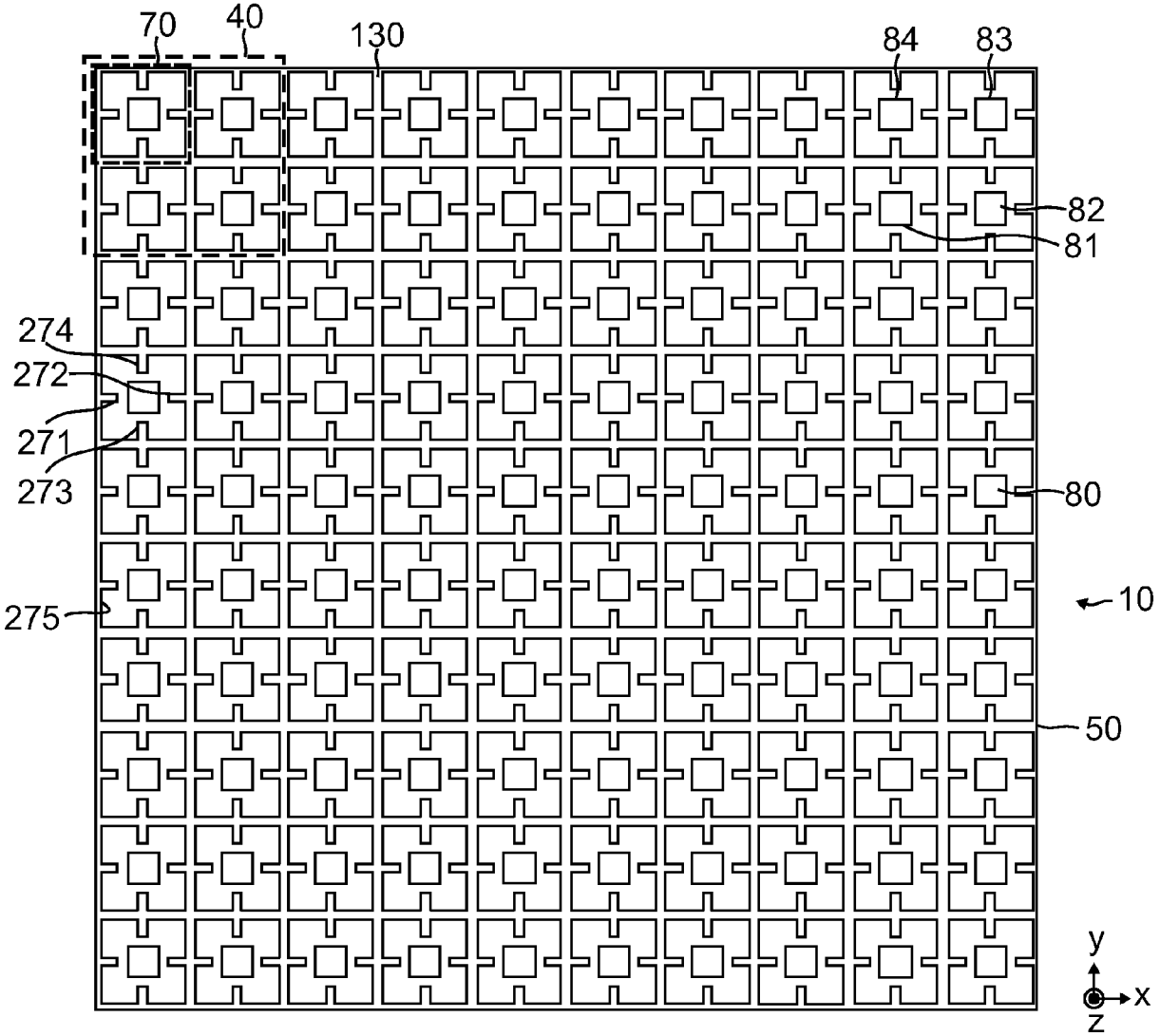
FIG. 5 is a top view of the antenna of FIG. 2.
Figure 6:
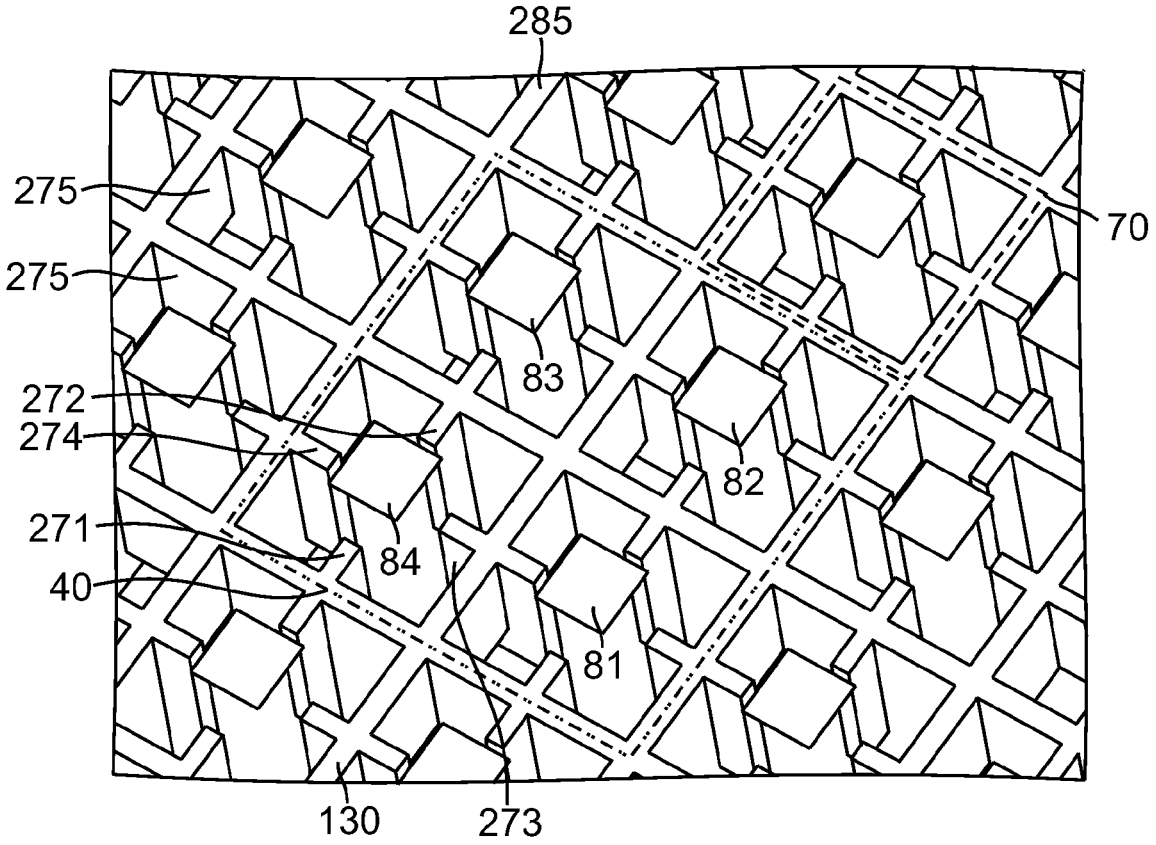
FIG. 6 is an enlarged view of an embodiment of a quad-ridged-waveguide array of two-by-two (2×2) arrays of quad-ridged waveguide sections in accordance with the present invention.

FIG. 5 is a top view of the antenna 10 of FIG. 2. FIG. 6 is an enlarged view of an embodiment of a quad-ridged-waveguide array 60 of two-by-two (2×2) arrays 40 of quad-ridged waveguide sections 70 in accordance with the present invention. The two-by-two (2×2) arrays 40 are similar in structure and function to the two-by-two (2×2) array 240 of FIGS. 1A and 1C. Thus, the quad-ridged waveguide sections 70 are similar in structure and function to the quad-ridged waveguide sections 270 of FIGS. 1A and 1C. In FIGS. 2, 5, and 6, only the patches 81-84 in the matching layer 80 are shown. The dielectric layers 181-185 (FIG. 1B) of the matching layer 80 are not shown to allow a view of the quad-ridged-waveguide array 60. The aperture side 130 (i.e., the top surface) of an exemplary quad-ridged waveguide section 70 is outlined by a dashed line 70. The aperture side of an exemplary two-by-two (2×2) array 40 of quad-ridged waveguide section 70 is outlined by a dash-double-dot line 40.

As shown in FIG. 2, the aperture mode filter 30 is applied above an array of large horn (or other) antenna radiating elements to suppress undesired grating lobes. Since the grating lobes can cause undesired interference in communication systems and reduce power (gain) of the radiation in the desired direction, it desirable to reduce or eliminate grating lobes.

The aperture mode filter 30 is integrated directly above horn antennas 21-25. The horn antennas 21-25 include a smaller input square waveguide 221 and horns 222 (FIG. 1A), which taper to a square output dimension of approximately two wavelengths, 2λ, of electromagnetic radiation emitted by the antenna radiating element 20 at the highest frequency of operation. Without the aperture mode filter 30, an array of horns 20 would radiate in directions other than the intended direction broadside (i.e., along the z axis) to the aperture mode filter 30. The horn apertures 231 (FIG. 1A) of the horns 21-25 are extended with the moder or extension-array 50 that has an array of square cross-sectional sections (i.e., waveguide extensions 51-55) with dimensions of $L_x$ and $L_y$ each on the order of two wavelengths, 2λ, of electromagnetic radiation emitted by the antenna 10, i.e., $L_x=L_y\approx 2\lambda$. Thus, as described above, the waveguide extensions 51-55 are an important part of the mode filter 30 that allows the reduction of higher order modes, which would otherwise couple to the higher-order Floquet modes. In one implementation of this embodiment, the aperture mode filter array 30 includes two or more extension-arrays 50 with different x-y dimensions that are stacked (in the z direction) between the antenna-array 20 and the quad-ridged-waveguide array 60.

As shown in FIG. 2, the mode filter 30 includes a quad-ridged-waveguide array 60 of 2×2 arrays 40 of quad-ridged waveguide sections 70 connected directly to the moder or extension-array 50. In some cases, portions 75 (FIG. 1A) of the quad-ridged-waveguide array 60 extend at least partially into the respective waveguide extensions 51-55 of the extension-array 50. The ridge sections, represented generally at 271-274 in FIGS. 1C, 5 and 6, of quad-ridged waveguide sections 70 extend slightly into the moder air region (i.e., penetrate the plane 295 shown in cross section in FIG. 1A) while the walls represented generally at 275 (FIGS. 5 and 6) of the quad-ridged waveguide sections 70 remain at the level of the top of the side walls represented generally at 241 (FIG. 4) of the waveguide extensions 51-55 in the extension-array 50. The aperture mode filter array 30 divides the output of the larger overmoded square waveguide horn 222 (FIG. 1A) into four equal square quad-ridged waveguide sections 70 each having cross-sectional dimensions on the order of $1\lambda=\frac{1}{2}L_x=\frac{1}{2}L_y$. For practical purposes, the 2k and 1k dimensions are approximations and the actual sizes can vary slightly.

The quad-ridged waveguide sections 270 that extend into the space enclosed by waveguide extension 51 enable the antenna 10 to support two orthogonal linear polarizations. Without ridges 271-274, the structure would be a square waveguide below cutoff and would not propagate some lower frequencies of interest. Without ridges 271-274, practical metal thicknesses side walls 275 of the quad-ridged waveguide section 70 limit the lower frequency of operation of the mode filter 30. The ridges 271-274 offer design freedom in overcoming these limitations.

A dual-polarization, dual-frequency antenna array designed to radiate broadside (in the z direction) at the higher frequency band while minimizing grating lobes, requires a grid spacing for the antenna elements that is no larger than one wavelength 1λ. However, this dense element spacing leads to significant packaging and element-feeding challenges. The mode filter 30 enables larger antenna elements 21-25, with a center-to-center spacing between neighboring antenna radiating elements of approximately 2λ, to be used. The antenna 10 requires fewer antenna elements 21-25 and associated feeds than prior art dual-polarization, dual-frequency antenna arrays. The mode filter 30 also reduces the remaining number of power divisions. The mode filter 30 reduces cost and lowers manufacturing risk for dual-polarized, dual-frequency antenna apertures such as those for K-band (20 GHz) and Ka-band (30 GHz).

In one implementation of this embodiment, there are no metal ridges 271-274 that extend from the side walls 275 of the quad-ridged waveguide section 270. In this embodiment, the mode filter includes at least one waveguide extension to extend the at least one element aperture; and at least one two-by-two (2×2) array of rectangular waveguide sections connected to the respective at least one waveguide extension, so that when the at least one waveguide extension is positioned between the at least one element aperture and the at least one 2×2 array of rectangular waveguide sections, undesired electromagnetic modes of the antenna are suppressed. In another implementation of this embodiment, the 2×2 array of rectangular waveguide sections is filled with dielectric material.

The at least one layer 80 (also referred to herein as an "array of matching layers 80) positioned adjacent to an aperture side 130 of the quad-ridged-waveguide array 60 at least reduces the reflection coefficient of the antenna-array 20. Other functions from the array of matching layers 80 are possible. The array of matching layers 80 include at least one dielectric layer and, in embodiments, include an array of metallic patches represented generally at 81-84 that present a shunt capacitive reactance. In one implementation of this embodiment, the at least one layer 80 includes dielectric layers (such as, dielectric layers 181-185 shown in FIG. 1B) that present a shunt capacitive reactance and the array of metallic patches 81-84 that present a shunt capacitive reactance. As shown in FIGS. 2, 5, and 6, metallic patches 81, 82, 83, and 84 are associated with respective quad-ridged waveguide section 70 so that each 2×2 array 40 is associated with four metallic patches 81-84. In another implementation of this embodiment, the antenna radiating elements 21-25 in the antenna-array 20 are waveguide antennas.

Figure 7B:
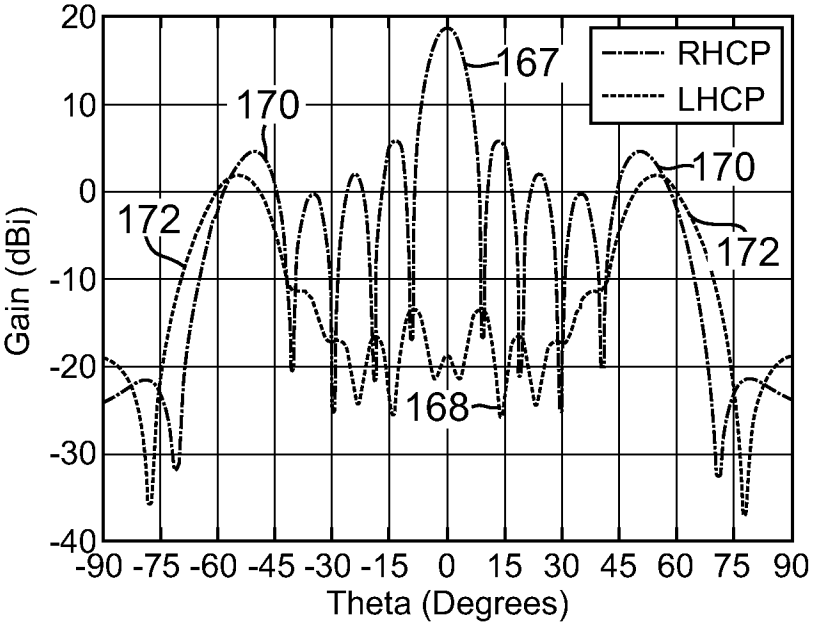
FIGS. 7A and 7B show gain simulated for an exemplary 1×5 antenna array with and without, respectively, an aperture mode filter configured in accordance with the present invention.
Figure 7A:
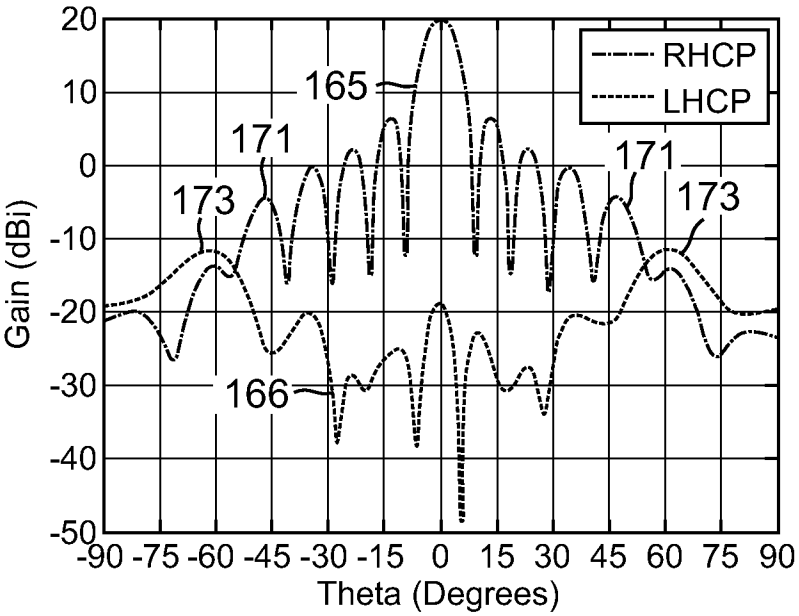

FIGS. 7A and 7B show gain simulated for an exemplary 1×5 antenna array with and without, respectively, an aperture mode filter 30 configured in accordance with the present invention.

As shown in FIG. 7A, curve 165 is a plot of gain in dB versus angle θ in degrees for right-handed circular polarization emitted from the 1×5 antenna array configured with an aperture mode filter. As shown in FIG. 7A, curve 166 is a plot of gain in dB versus angle θ in degrees for left-handed circular polarization emitted from the 1×5 antenna array configured with an aperture mode filter. As shown in FIG. 7B, curve 167 is a plot of gain in dB versus angle θ in degrees for right-handed circular polarization emitted from the 1×5 antenna array configured without an aperture mode filter. As shown in FIG. 7B, curve 168 is a plot of gain in dB versus angle θ in degrees for left-handed circular polarization emitted from the 1×5 antenna array configured without an aperture mode filter.

With the mode filter 30 in place, the grating lobes 170 and 172 in FIG. 7B are reduced as evident from side lobes 171 and 173 in FIG. 7A so the antenna-array far-field pattern has acceptable side lobe levels and directivity. The grating lobes 170 (the fourth side lobes) in curve 167 of FIG. 7B are much larger than the side lobes 171 in curve 165 of FIG. 7A since the aperture mode filter has reduced the power in the side lobes right-handed circular polarization emitted from the 1×5 antenna array. Likewise, the grating lobes 172 in curve 168 of FIG. 7B are much larger than the grating lobes 173 in curve 166 of FIG. 7A since the aperture mode filter has reduced the power in the side lobes for the left-handed circular polarization emitted from the 1×5 antenna array. In other words, coupling from the antenna array to the higher order Floquet modes is decreased.

Figure 8:
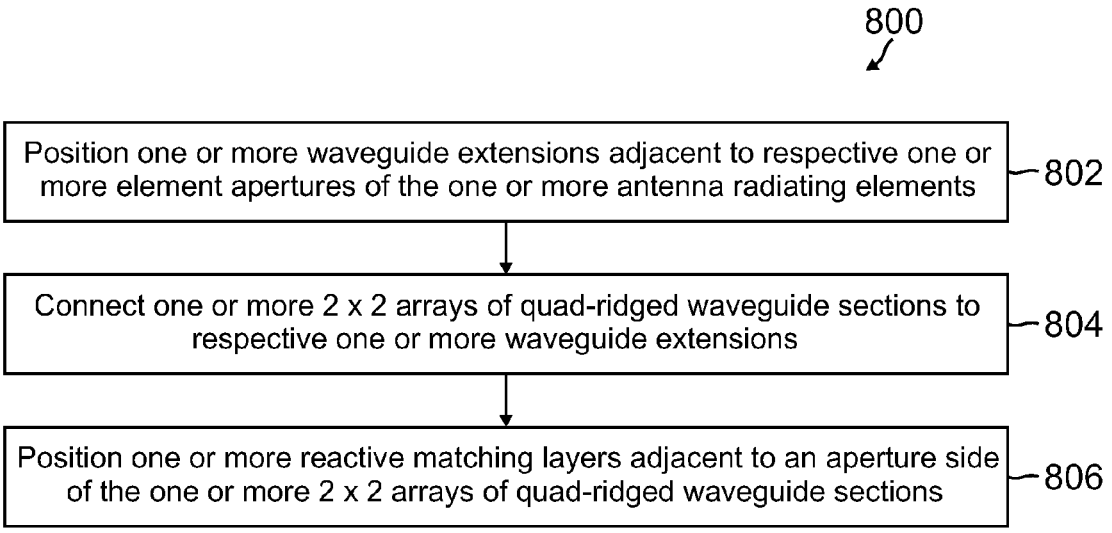
FIG. 8 is an embodiment of a method of suppressing undesired electromagnetic modes of one or more antenna radiating elements in accordance with the present invention.

FIG. 8 illustrates a method 800 representative of a method of suppressing undesired electromagnetic modes of one or more antenna radiating elements 20-25 in accordance with the present invention.

At block 802, one or more waveguide extensions 51-54 are positioned adjacent to respective one or more element apertures 121-125 of the one or more antenna radiating elements 21-25 (FIG. 4). A dimension $L_x$ of the one or more waveguide extensions 51-54 in a plane (x-y) parallel to a plane (x-y) of the element aperture 121-125 is on the same order as the dimension $L_x$ of the element aperture 121-125. Likewise, dimension $L_y$ of the one or more waveguide extensions 51-54 in a plane (x-y) parallel to a plane (x-y) of the element aperture 121-125 is on the same order as the dimension $L_y$ of the element aperture 121-125. In one implementation of this embodiment, one or more waveguide extensions 51-54 are positioned adjacent to one or more element apertures 121-125 of a horn element 20. In another implementation of this embodiment, one or more waveguide extensions 51-54 are positioned adjacent to one or more element apertures 121-125 of a waveguide antenna element.

In yet another implementation of this embodiment, the mode filter includes two or more extension-arrays 50 (or two or more waveguide extension 251) stacked with one on top of the other. This embodiment is shown in FIG. 9. FIG. 9 is a cross-section view of an embodiment of an antenna 14 with a single antenna radiating element 220 in accordance with the present invention. The antenna 14 includes the single antenna radiating element 220 and an aperture mode filter 330. The aperture mode filter 330 includes a 2×2 array 240 of quad-ridged waveguide sections 270, a first waveguide extension 251-1, and a second waveguide extension 251-2. The first waveguide extension 251-1 and the second waveguide extension 251-2 have different dimensions in the x-y plane.

The first and second waveguide extensions 251-1 and 251-2 are stacked one on top of the other (in the z direction perpendicular to the element aperture 231) to form waveguide extension 351. Specifically, the second waveguide extension 251-2 is positioned between the first waveguide extension 251-1 and the 2×2 array 240 of quad-ridged waveguide sections 270. The first and second waveguide extensions 251-1 and 251-2 each have a height "h" in the z direction so the waveguide extension 351 has the height "2 h". In one implementation of this embodiment, the first waveguide extension 251-1 and the second waveguide extension 251-2 have different heights.

The waveguide extension 251-1 has the dimensions $L_x$ and $L_y$ (only the x dimension is shown in FIG. 9). The waveguide extension 251-2 has dimensions $L_x+2\Delta L_x$ and $L_y+2\Delta L_y$. Due to the slightly different dimensions in the x-y plane, the waveguide extensions 251-1 and 251-2 have different propagation constants, which are set by the transverse dimensions (i.e., $L_x$, $L_y$). These the waveguide extensions 251-1 and 251-2 adjust phasing between the forward and reverse waves of the various modes to cancel unwanted modes.

The waveguide extension 351 is positioned between the 2×2 array 240 of quad-ridged waveguide sections 270 and the element aperture 231. The mode filter 330 also includes a reactive matching layer 280 positioned adjacent to or spaced above the aperture side 285 of the 2×2 array 240 of quad-ridged waveguide sections 270.

In another implementation of this embodiment, the aperture mode filter 330 includes three waveguide extensions, each with slightly different transverse dimensions stacked along the z direction one on top of the other. In yet another implementation of this embodiment, the aperture mode filter 330 includes three waveguide extensions, in which two waveguide extensions with the same transverse dimensions are stacked (along the z direction) to sandwich a third waveguide extension with a different transverse dimension.

In yet another implementation of this embodiment, an antenna includes at least a first extension-array of first waveguide extensions 251-1 having a first transverse dimension and a second extension-array of second waveguide extensions 251-2 having a second transverse dimension. In the latter embodiment, the first extension-array of first waveguide extensions 251-1 and the second extension-array of second waveguide extensions 251-2 are stacked, one on the other, in a direction perpendicular to the transverse dimension (i.e., in the z direction).

In embodiment in which, the mode filter includes two or more extension-arrays 50 (or waveguide extensions 251) stacked one on top of the other, block 802 is implemented by positioning one or more first waveguide extensions 251-1 adjacent to respective one or more element apertures 231 of the one or more antenna radiating elements 20, and positioning one or more second waveguide extensions 251-2 adjacent to respective one or more first waveguide extensions 251-1.

At block 804, one or more two-by-two (2×2) arrays 40 of quad-ridged waveguide sections 70 are connected to respective one or more waveguide extensions 51-54, so that higher order modes of the electromagnetic radiation emitted from the antenna radiating elements 21-25 are reduced. The one or more waveguide extensions 51-54 are attached to the respective one or more element apertures 121-125 of the antenna radiating elements 21-25. In one implementation of this embodiment, one or more two-by-two (2×2) arrays 40 of quad-ridged waveguide sections 70 are connected to respective one or more waveguide extensions 51-54, so that a portion 75 of the 2×2 array 40 of quad-ridged waveguide sections 70 extend at least partially into the associated waveguide extension 51-54.

At block 806, one or more reactive matching layers is positioned adjacent to an aperture side 130 of the one or more 2×2 arrays 40 of quad-ridged waveguide sections 70 to reduce a reflection coefficient of the one or more antenna radiating elements 20.

In this manner, higher order modes of the electromagnetic radiation emitted from the antenna radiating elements 21-25 are reduced. Specifically, the mode filter 30 mitigates higher order modes from the antenna array 20 in order to prevent them from coupling to the higher order Floquet modes. With the mode filter 30 in place, the grating lobes are reduced and the antenna array far field pattern has acceptable side lobe levels and directivity.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A mode filter for a horn antenna having at least one radiating element with at least one horn aperture, the mode filter comprising:

at least one waveguide extension to extend the at least one element horn aperture; and at least one two-by-two (2×2) array of quad-ridged waveguide sections connected to the respective at least one waveguide extension, wherein, when the at least one waveguide extension is positioned between the at least one horn aperture and the at least one 2×2 array of quad-ridged waveguide sections, undesired electromagnetic modes of the horn antenna are suppressed, wherein a portion of at least one of the at least one 2×2 array of quad-ridged waveguide sections extends at least partially into the respective at least one of the at least one waveguide extension.

2. The mode filter of claim 1, further comprising:

at least one layer positioned adjacent to an aperture side of the at least one 2×2 array of quad-ridged waveguide sections, the at least one layer configured to at least reduce a reflection coefficient of the horn antenna.

3. The mode filter of claim 2, wherein the at least one layer is comprised of at least one dielectric layer or at least one dielectric layer and at least one metallic patch.

4. The mode filter of claim 1, wherein the at least one waveguide extension comprises at least two waveguide extensions having at least two respective transverse dimensions that differ from each other, wherein the at least two waveguide extensions having at least two respective transverse dimensions are stacked in a direction perpendicular to a plane spanned by the at least one horn aperture.

5. The mode filter of claim 1, wherein the at least one waveguide extension comprises an extension-array of waveguide extensions, wherein the at least one 2×2 array of quad-ridged waveguide sections comprises a quad-ridged-waveguide array of 2×2 arrays of quad-ridged waveguide sections, and wherein the at least one radiating element of the horn antenna comprises an antenna-array of radiating elements having a respective array of horn apertures, such that, when the extension-array is positioned between the array of horn apertures and the quad-ridged-waveguide array, undesired electromagnetic modes of the horn antenna are suppressed.

6. A horn antenna in which undesired electromagnetic modes are suppressed, the horn antenna comprising:

an antenna-array of antenna radiating elements having a respective array of horn apertures;

an extension-array of waveguide extensions adjacent to the array of horn apertures of the antenna-array of antenna radiating elements; and a quad-ridged-waveguide array of two-by-two (2×2) arrays of quad-ridged waveguide sections connected to the extension-array, wherein the extension-array is positioned between the quad-ridged-waveguide array and the antenna-array of antenna radiating elements, wherein a portion of at least one of the 2×2 arrays of quad-ridged waveguide sections extends at least partially into the respective at least one waveguide extension.

7. The horn antenna of claim 6, further comprising:

at least one layer positioned adjacent to an aperture side of the side of the quad-ridged-waveguide array, the at least one layer configured to at least reduce a reflection coefficient of the horn antenna.

8. The horn antenna of claim 7, wherein the at least one layer is comprised of at least one dielectric layer or at least one dielectric layer and at least one metallic patch.

9. The horn antenna of claim 6, wherein the extension-array of waveguide extensions includes:

a first extension-array of waveguide extensions having a first transverse dimension; and a second extension-array of waveguide extensions having a second transverse dimension, wherein the first extension-array of waveguide extensions and the second extension-array of waveguide extensions are stacked in a direction perpendicular to a plane spanned by the horn apertures.

10. The horn antenna of claim 6, wherein a dimension of the waveguide extensions, in a plane parallel to a plane spanned by the horn apertures, is on the same order as a dimension of the associated horn apertures.

11. The horn antenna of claim 6, wherein a center-to-center spacing between neighboring antenna radiating elements in the antenna-array is approximately twice a wavelength of electromagnetic radiation emitted by the antenna radiating elements.

12. The horn antenna of claim 6, wherein the antenna radiating elements of the antenna-array have aperture dimensions of approximately twice a wavelength of electromagnetic radiation emitted by the antenna radiating elements.

13. A method of suppressing undesired electromagnetic modes of a horn antenna including one or more antenna radiating elements, the method comprising:

positioning one or more waveguide extensions adjacent to respective one or more horn apertures of the one or more antenna radiating elements; and connecting one or more two-by-two (2×2) arrays of quad-ridged waveguide sections to respective one or more waveguide extensions, so that portions of at least one of the one or more 2×2 arrays of quad-ridged waveguide sections extend at least partially into the respective at least one of the one or more waveguide extensions.

14. The method of claim 13, wherein positioning the one or more waveguide extensions adjacent to the respective one or more horn apertures comprises attaching the one or more waveguide extensions to the respective one or more horn apertures.

15. The method of claim 13, further comprising:

positioning one or more layers adjacent to an aperture side of the one or more 2×2 arrays of quad-ridged waveguide sections to reduce a reflection coefficient of the one or more antenna radiating elements.

16. The method of claim 13, wherein positioning the one or more waveguide extensions adjacent to the respective one or more horn apertures of the one or more antenna radiating elements comprises:

positioning one or more first waveguide extensions adjacent to respective one or more horn apertures of the one or more antenna radiating elements; and positioning one or more second waveguide extensions adjacent to respective one or more first waveguide extensions.

17. The mode filter of claim 1, wherein at least one of the quad-ridged waveguide sections include ridges that extend from at least one of the side walls of the at least one quad-ridged waveguide section into the at least one quad-ridged waveguide section.

* * * * *